US006578890B1

(12) United States Patent
Gilmore et al.

(10) Patent No.: US 6,578,890 B1
(45) Date of Patent: Jun. 17, 2003

(54) SNOW GRABBER

(76) Inventors: Blaine Gilmore, 127 Peninsula Dr., Lake Alminore, CA (US) 96137; Dale Marvin Ross, 127 Peninsula Dr., Lake Alminore, CA (US) 96137

( * ) Notice: Subject to any disclaimer, the term of this patent is extended or adjusted under 35 U.S.C. 154(b) by 0 days.

(21) Appl. No.: 09/099,648

(22) Filed: Jun. 18, 1998

(51) Int. Cl.[7] ..... E01H 5/02
(52) U.S. Cl. ..... 294/54.5; 294/53.5; 37/285
(58) Field of Search ..... 294/49, 51, 53.5, 294/54.5; 37/265, 267, 285

(56) References Cited

U.S. PATENT DOCUMENTS 1,202,791 A * 10/1916 Brownstein ..... 37/285
2,089,245 A * 8/1937 Barron ..... 294/53.5
3,091,790 A * 6/1963 Schroeder ..... 37/285
3,483,643 A * 12/1969 Wenzel ..... 294/54.5
3,583,747 A * 6/1971 Lambert ..... 37/285
4,249,767 A * 2/1981 Andreasen ..... 294/54.5
5,524,369 A * 6/1996 Phillips ..... 294/54.5
5,676,413 A * 10/1997 Hauck ..... 294/54.5
5,791,707 A * 8/1998 Szakurski ..... 294/54.5

* cited by examiner

*Primary Examiner*—Dean J. Kramer
(74) *Attorney, Agent, or Firm*—Brian C. Kelly JD LLM

(57) ABSTRACT

A snow removal device for elevated positions, such as roofs, while remaining on the ground. The device includes a shovel type head 10 which folds back, to assist the slide motion up the surface of a pitched roof. The shovel type head 10 is spring 14 loaded to open upon the pull action. When in use, the operator places the shovel type head 10 end of the device on top of the snow covered surface. In this position, the shovel type head 10 is hinged back so as to have the convex side of the shovel type head 10 to the surface of the snow. This allows the device, with a pushing motion, while extending the pole handle 15, to slide on or near the surface. When the desired distance is reached, the pulling back motion of the handle 15 opens the shovel type head 10 with assistance of the spring 14 and resistance to the snow. This forms a scoop, or plow action, dislodging and removing snow downward from the roof. This device allows for the shovel type head 10 to reverse direction, so the device can be used to push, as well as, pull material.

2 Claims, 3 Drawing Sheets

SNOW GRABBER

BACKGROUND

1. Field of Invention

This invention relates to snow removal devices, specifically to such devices for the removal of snow from a roof, while remaining on the ground.

2. Description of Prior Art

Snow has accumulated on roofs for generations. The common practice is to remove the snow, with a shovel, while standing on the roof, a dangerous and a very treacherous task.

Inventions were created to remove roof snow from the ground such as patent number 3998486, made by Mr. Mittelstadt. Mr. Mittelstadt's unit uses a sheet of plastic pushed up though roof snow by a forked tool on rollers. Although the unit works, it is limited by the depth and consistency of snow the tool could penetrate, as well as, the tool's difficulty in going around obstructions with ease. Skylights, chimneys, or vent pipes, might cause the plastic sheet to twist or snag on gutters or roof materials, and require replacement if frequently used.

Other inventions, such as patent number 4848819, made by Mr. Moorefield, use a flat blade or rake to reach and pull down snow from the roof with the following disadvantages:

a. The handles are often limited in length, do not telescope, or have extensions for greater reach due to limited control.

b. The blade part of the removal unit is often heavy at the end of the long handle and difficult to lift up and use.

c. The blade being fixed, or of limited motion, does not allow the operator to easily put the blade in place without a great lift and a drop action onto the roof. The roof might be damaged by this drop or chopping action.

d. Other shovel type heads, scoops, or rakes may pivot or may be angularly adjusted, but are still limited by reach, shape, and weight of the head for easy placement on the roof, or still require lifting the load in a shoveling manner.

OBJECTS AND ADVANTAGES

Accordingly the objects and advantages of our invention are:

a. To provide a device to remove snow from the roof while safely on the ground.

b. To provide a device to reduce the effort required to remove the snow load from the roof.

c. To provide a device to work in any depth, or consistency, of snow load.

d. To provide a device with greater reach capacity, while maintaining better control.

e. To provide a device that requires limited maintenance or replacement parts.

f. To provide a device that can be easily stored.

g. To provide a device that would also work more effectively, even if one should desire or need to remove snow, while on the roof. One can now stand on the peak of the roof and just push the snow down and off the roof, without having to walk around on a snow and ice covered surface.

h. To provide a device with a load distributing frame to provide smooth, even, less straining method of operation.

Further objects and advantages are to provide a Snow Grabber that can be made of a plastic or fiberglass type material, for lighter weight, to increase control, and to reduce exertion. Also to provide a device small enough for cars, storage, other outside buildings, as well as, larger ones for structures such as, schools, stores, or lodges. Some may even be made more durable for built-up ice removel. Other objectives and advantages may become apparent from consideration of ensuing description and drawings.

DRAWING FIGURES

FIG. 1 shows the shovel type head 10 in the open position, and that the handle mount 13 is reversible at the attachment point to reverse the head to work in the push, rather than pull position.

FIG. 2 shows the shovel type head 10 in the retracted position, as when placed on top the surface of the snow, to slide on or up the snow's surface, to the reach desired.

FIG. 3 shows the individual parts of the Snow Grabber, and the manner of assembly.

FIG. 4 shows the standard practice of removing snow from a roof and the positions of the Snow Grabber while in use.

Figure 1:
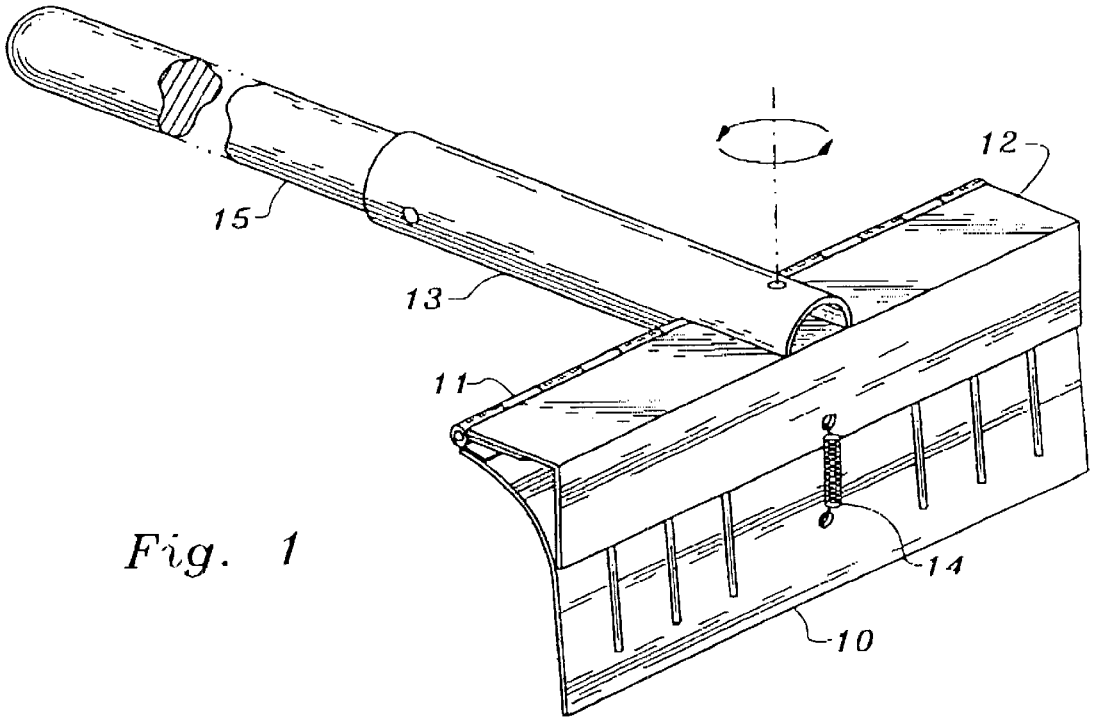
FIGS. 1 through 4 show various aspects of the Snow Grabber, in the working positions.

Reference numerals in drawings are as follows:

| | |
|---|---|
| 10 | shovel type head |
| 11 | hinge |
| 12 | frame |
| 13 | handle mount |
| 14 | spring |
| 15 | pole handle |

SUMMARY

In accordance with the present invention, the Snow Grabber is a snow removal device that comprises a hinged shovel type head, that retracts to assist placement on the roof, and is spring assisted to open for use. The hinged, shovel type head, is attached to a frame that distributes the snow load evenly across the shovel type head.

The Snow Grabber is equipped with a handle mount that can be reversed to provide a device that can work with either a push or a pull motion. The handle is comprised of extensions connected together, or has a telescoping action to reach the desired length.

Description—FIGS. 1 Through 4

FIG. 1, page 1 of 3, a typical embodiment of the present invention is illustrated. The shovel type head 10 is in the hinged open position. The hinge 11 is not clearly visible, but is displayed in FIG. 3. The shovel type head 10 is supported by the frame 12, which distributes the snow load evenly across the shovel type head 10. The spring 14 is attached to the frame 12 and shovel type head 10 in the relaxed position. The handle mount 13 is in the standard position, or can be rotated 180 degrees to allow the device to be used in the opposite direction if required. The pole handle 15 is comprised of various lengths, able to be connected or made in a telescoping design, depending on the distance of reach required.

Figure 2:
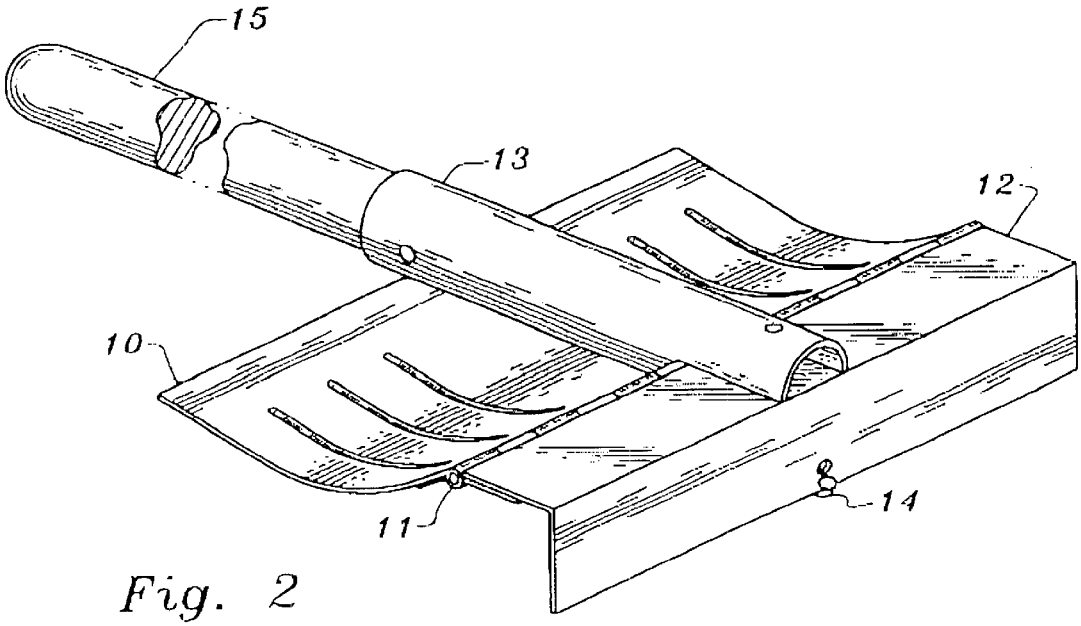

In FIG. 2, page 1 of 3, the shovel type head 10 is in the hinged back position to allow the shovel type head 10 to slide across the snow covered surface. In this position the spring 14, not clearly visible, is in its stretched position to assist the opening action.

Figure 3:
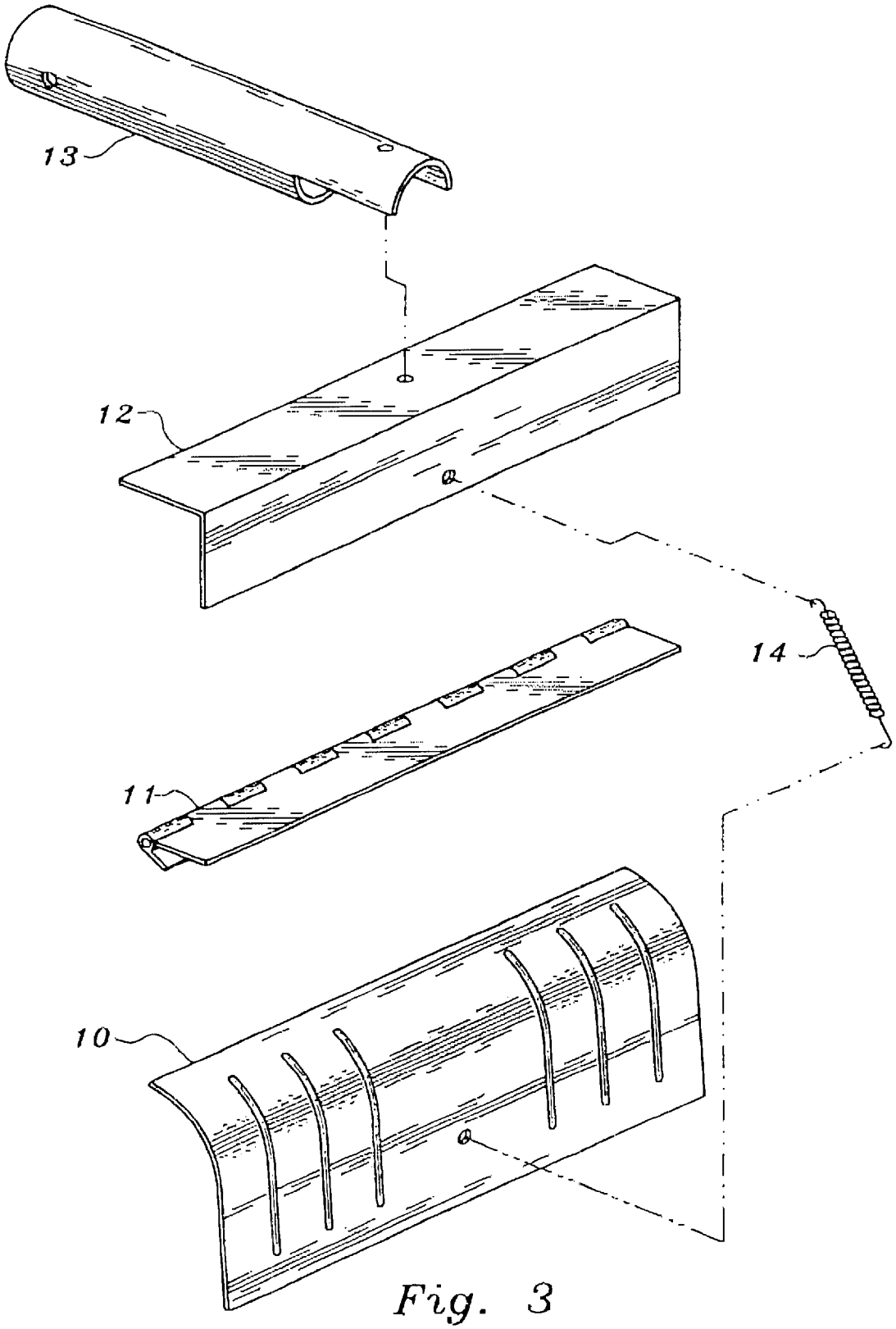

FIG. 3, page 2 of 3, shows the relationship of the individual parts, shovel type head 10, hinge 11, frame 12, handle mount 13, and a partial handle 15, and spring 14.

Figure 4:
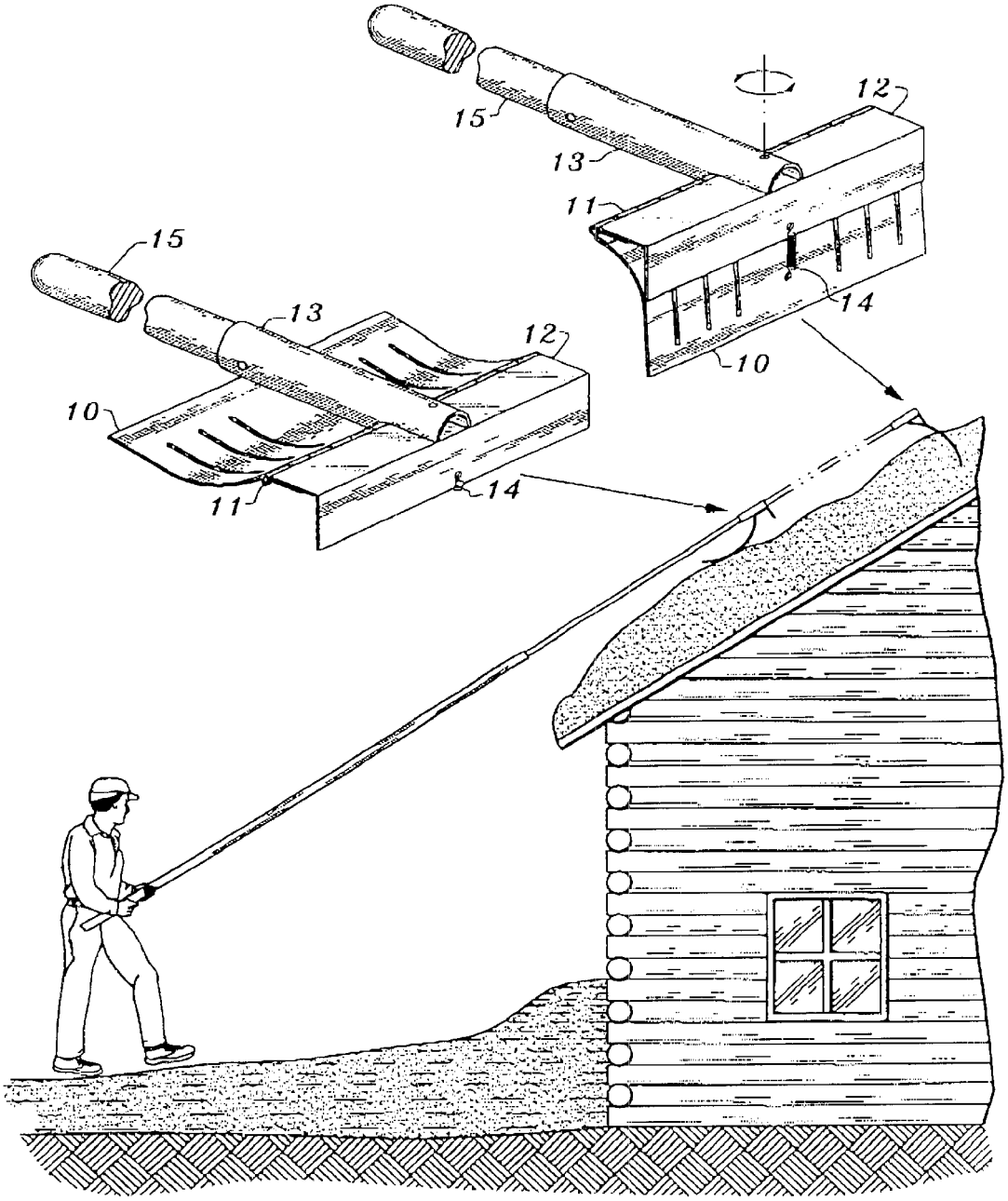

FIG. 4, page 3 of 3, illustrates the typical embodiment of the present invention. The operator has the device positioned for use. Enlargements show the shovel type head 10 when in operating positions. The shovel type head 10 part of the device is placed on the roof, and with a push or extending of the handle 15, slides on the surface, when retrieved, the device opens to displace the snow downward and off the roof.

From the description above a number of advantages of our device become evident:

a. Snow can be removed from the roof, while on the ground, with less effort than shoveling.

b. Snow can be removed without the necessity of being on the roof.

c. Snow can be removed without excessive exertion common with awkward shovel or rake devices.

d. The device can be used to drag or plow accumulated snow away from the house, with less effort than shoveling.

e. For those applications when the operator wishes to be on the roof, the device allows them to stay on the peak and displace snow downward and off, without having to walk around on the rest of the roof itself.

f. The handle can be removed and the shovel type head folded for easy storage.

g. Having an extendable handle allows the operator to stand safely clear of falling snow.

h. The device should allow one to be able to accomplish the job more quickly because of less wasted motion.

i. The device has limited operating parts to avoid needed replacement.

j. shovel type head is a rectangular plate, concaved from top to bottom, approximately 180 degrees with reinforced corrugations.

k. The hinge is attached by welds or fasteners like bolts, nuts, rivets, screws or other such means.

l. The pole handle can be made of various materials such as aluminum, steel, plastic, fiberglass or other synthetics.

Operation—FIGS. 1 Through 4

The manner of using this device is to set the shovel type head on the lowest surface of the roof, and extend the pole handle, in a sliding motion, up the snow covered surface. When the appropriate distance is reached, the pulling back motion on the handle, with assistance from the spring, and the snow itself, opens the shovel type head, as in FIG. 1, and with a pull of the handle, displaces snow from the roof.

CONCLUSION, RAMIFICATIONS AND SCOPE

Accordingly, the reader will see that the Snow Grabber invention can remove snow, possibly ice or debris, from roofs easily and efficiently.

In addition the Snow Grabber has additional advantages in that:

a. It allows an operator of less physical ability to clear a roof, because less energy is required to operate.

b. The Snow Grabber allows a home owner to save expensive roof snow removal cost because the owner could not physically operate on, or reach enough roof surface.

c. The Snow Grabber allows one to remove, often heavy, snow fall without adding the operator's weight to an already stressed roof.

d. The Snow Grabber may possibly reduce insurance premiums by showing an effective system to remove snow load and reduce the possibility of structural failure claims.

e. The Snow Grabber may reduce the snow removal costs insurance companies and home owners now pay for snow removal, from threatened structures, as often as required per season.

f. The Snow Grabber may provide the opportunity for the neighbors son who shovels your sidewalk, to clear your roof snow without the added risk of injury from falling off your roof.

Although the description above contains many specificities, these descriptions should not be construed as limiting the scope of the invention, but merely providing illustrations of the presently preferred embodiments of this invention. For example, the edge of the shovel type head might have rounded corners, or be equipped with a rubber type lip, so as not to harm the roofs surface. It might even be equipped with rake type teeth, to provide additional grab or grip for ice or other conditions. Thus the scope of the invention should be determined by the appended claims and their legal equivalents, rather than by the examples given.

We claim:

1. An apparatus for removing snow from an elevated surface comprising a shovel head; hinged means for attaching said shovel head to a frame for transfer of load to a handle attached to said frame by attachment means further comprising spring tension means to bias said shovel head to an open position.

2. An apparatus for removing snow from an elevated surface as stated in claim 1 further comprising removable fastering means for releasing said spring means for strage.

* * * * *